US006575398B2

(12) United States Patent
Nakamura et al.

(10) Patent No.: US 6,575,398 B2
(45) Date of Patent: Jun. 10, 2003

(54) REEL FOR EMBOSSED CARRIER TAPE

(75) Inventors: Yoshio Nakamura, Kanagawa (JP); Haruo Umeda, Chiba (JP); Li Xiao, Tokyo (JP)

(73) Assignee: Tyco Electronics. AMP, K.K., Kanagawa (JP)

( * ) Notice: Subject to any disclaimer, the term of this patent is extended or adjusted under 35 U.S.C. 154(b) by 0 days.

(21) Appl. No.: 09/910,560

(22) Filed: Jul. 20, 2001

(65) Prior Publication Data

US 2002/0074449 A1 Jun. 20, 2002

(30) Foreign Application Priority Data

Jul. 27, 2000 (JP) ..... 2000-226525

(51) Int. Cl.[7] ..... B65H 75/14; B65H 75/22

(52) U.S. Cl. ..... 242/608.7; 242/118.61; 242/118.8; 242/608.7; 242/608.8; 242/609.1; 242/610.2

(58) Field of Search ..... 242/608.7, 608.8, 242/609, 609.1, 610.1, 610.2, 118.6, 118.61, 118.8

(56) References Cited

U.S. PATENT DOCUMENTS 2,799,458 A * 7/1957 Nye ..... 242/118.8
3,059,763 A * 10/1962 Eifrid ..... 242/610.1 X
3,101,846 A * 8/1963 Eifrid ..... 242/601.1 X
3,278,135 A * 10/1966 Black ..... 242/118.8
3,284,022 A * 11/1966 Eifrid ..... 242/608.7
3,412,847 A * 11/1968 Wise et al. ..... 242/610.1 X
3,853,286 A * 12/1974 Beder et al. ..... 242/118.8 X
3,876,073 A * 4/1975 Herbetko ..... 242/608.7
3,958,775 A * 5/1976 Liga ..... 242/118.8
5,735,483 A * 4/1998 Bierlein ..... 242/608.7
5,791,590 A * 8/1998 Zuk et al. ..... 242/608.7 X

FOREIGN PATENT DOCUMENTS

DE 37 03 018 A1 * 8/1987 ..... 242/608.7 X

* cited by examiner

*Primary Examiner*—Kathy Matecki
*Assistant Examiner*—Minh-Chau Pham

(57) ABSTRACT

A pair of flanges (12, 12) which have through-holes (17) for a rotating shaft, and a shaft part which connects the central parts of these flanges (12, 12) at a specified spacing, are formed from cardboard plates; furthermore, the above-mentioned shaft part is formed so that this shaft part is foldable. For example, flaps (13) which extend in the radial direction, and which have base ends (13*a*) on the side of the central part of the corresponding flange (12) are formed by stamping in each of the pair of flanges (12, 12) and slits (14) which extend in the circumferential direction of each flange (12) are formed on a circle that is concentric with the flange (12), and which includes the base ends (13*a*) of the flaps (13). The flaps (13) of the respective flanges (12) are pulled into upright positions, and the projecting parts (13*b*) of the flaps (13) of one of the flanges (12) are inserted into the slits (14) of the other flange (12), thus fastening the flanges (12) to each other, so that a reel (11) is formed. A reel formed as described is not bulky during shipping, and requires no separation of parts when the reel is discarded.

13 Claims, 15 Drawing Sheets

REEL FOR EMBOSSED CARRIER TAPE

FIELD OF THE INVENTION

The present invention relates to a reel which is used to store and transport electronic parts which are provided on an embossed carrier tape or the like. The reel is further used to supply the parts to an automated assembly machine.

BACKGROUND OF THE INVENTION

Embossed carrier tapes are carrier tapes in which recesses are formed at a specified spacing along the direction of length of a synthetic resin tape. Electronic parts such as connectors, etc., are inserted into these recesses and the upper surface of the carrier tape is then covered with a covering tape and heat-sealed so that the electronic parts are sealed inside the recesses. An embossed carrier tape reel is used to take up the embossed carrier tape with the electronic parts sealed inside such that the parts are supplied to an automatic assembly machine or other similar device.

As is shown in FIGS. 18 and 19, the embossed carrier tape reel 270 is installed at the end of a sealing device 200. In this sealing device 200, electronic parts, etc., are inserted into the recesses of the resin tape in a product insertion stage 210. The tape is covered with a covering tape 30 by a tape supplying means 230. The covering tape 30 is pulled out and supplied from a reel 231 and the covering tape 30 and resin tape are clamped and bonded by a heater 251 and a receiving pad 252 which are disposed above and below the conveying path, such that the covering tape 30 is bonded to the resin tape by a tape bonding means 250, so that an embossed carrier tape 40 with electronic parts sealed inside is manufactured. The embossed carrier tape 40 manufactured is taken up by the embossed carrier tape reel 270, and is thus arranged in a configuration that is suitable for storage or conveying.

Traditionally, the reel is of the type shown in FIG. 20. This reel 91 consists of a pair of flanges 93 made of cardboard plates, which are connected by a shaft part 92 made of foam styrol. As a result, this reel 91 can be manufactured at low cost. Accordingly, reels that have once been used in an automated assembly machine may be discarded, so that the trouble of recovery is eliminated. This type of reel 91 is ordinarily manufactured at a place other than the plant where the electronic parts are sealed.

However, since the reel 91 is bulky, the cost of shipping such reels 91 from the place where the reels 91 are manufactured to the place where they are used is high. Furthermore, since the shaft part 92 made of foam styrol cannot be incinerated, time must be taken to separate the shaft part 92 from the flanges 93 when the reels 91 are discarded.

SUMMARY OF THE INVENTION

Accordingly, an object of the present invention is to provide a reel for an embossed carrier tape which is not bulky during shipping, and which does not require any separation of the components when discarded.

The present invention provides a reel for an embossed carrier tape which has a pair of flanges that have through-holes for co-operating with a rotating shaft. A shaft part is also provided on the reel and connects the central portions of the flanges at a specified spacing. The flanges and shaft part are made of cardboard plates with the shaft part having a foldable structure.

The space formed between the flanges can be eliminated by folding the shaft part, so that the reels can be stacked and shipped in large quantities, thus reducing the cost of shipping. Furthermore, since both the shaft part and flanges consist of cardboard plates, there is no need for separation of the components when the reels are discarded.

In one embodiment of the present invention, the shaft part consists of a plurality of flaps which are formed in at least one of the pair of flanges. The shaft part is formed by pulling the flaps into an upright position and inserting the tip end portions of these flaps into slits formed in the other flange.

In this configuration, the shaft part is formed by pulling flaps formed in at least one flange into upright positions and inserting the tip ends of these flaps into slits formed in the other flange. Accordingly, there is no need to install a shaft part that is separate from the flanges, and the number of parts required can therefore be reduced. Additionally, a bonding agent, etc., is not required, the flaps can merely be fastened to each other merely by inserting the tip end portions of the flaps formed in at least one flange.

In another embodiment, the shaft part has joining parts that are bonded to the central portions of each of the pair of flanges, and a plurality of plate-form members that connect these joining parts to each other. The plate-form members are formed parallel to each other and are arranged so that they can be pulled into an upright position with respect to the aforementioned joining parts.

In this configuration, the shaft part can be folded, and the flanges can be stacked together in a state in which the shaft part is joined to the flanges beforehand. Accordingly, the reels can be shipped in a compact configuration and the shaft parts can be raised and assembled in a one-touch operation at the time of use. Furthermore, reels with different. The flanges in each of these reels is uniform, thereby requiring the manufacture of a single flange configuration.

In yet another embodiment, the shaft part has a band-form member that can be connected into a tubular shape. A plurality of projecting parts which can be inserted into slits formed in the pair of flanges are disposed on both sides of the band-form member with respect to the direction of width of the band-form member.

In this configuration, reels with different flange spacings can be formed merely by changing the shaft part to a shaft part in which the width of the band-form member is different. Furthermore, if a bonding agent, etc., is not used, the flanges and shaft part can be fastened and secured together merely by inserting the projecting parts into the slits formed in the flanges.

DETAILED DESCRIPTION OF THE EMBODIMENTS SHOWN

Figure 1:
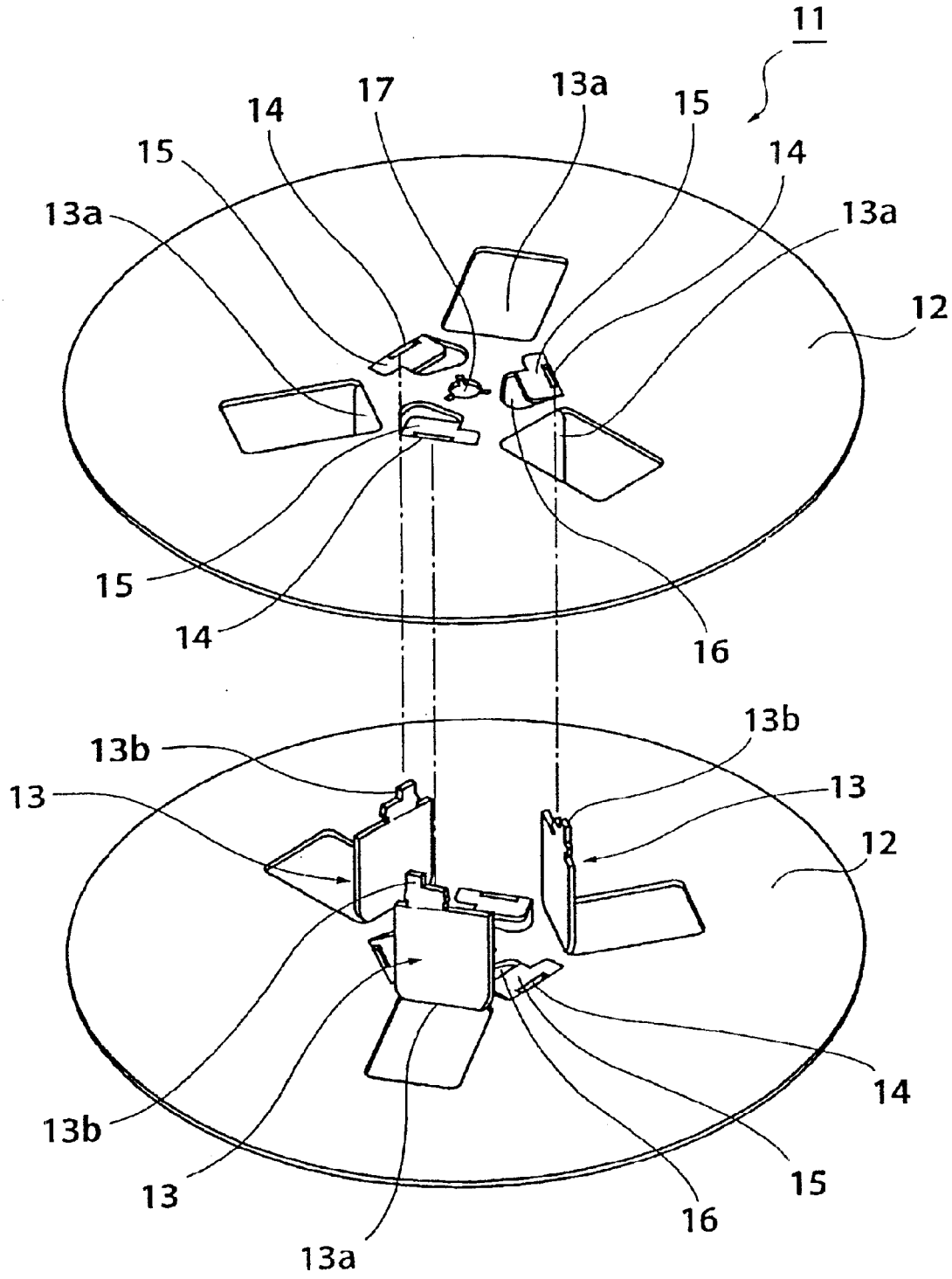
FIG. 1 is an exploded perspective view which illustrates one working configuration of the embossed carrier tape reel of the present invention.
Figure 2:
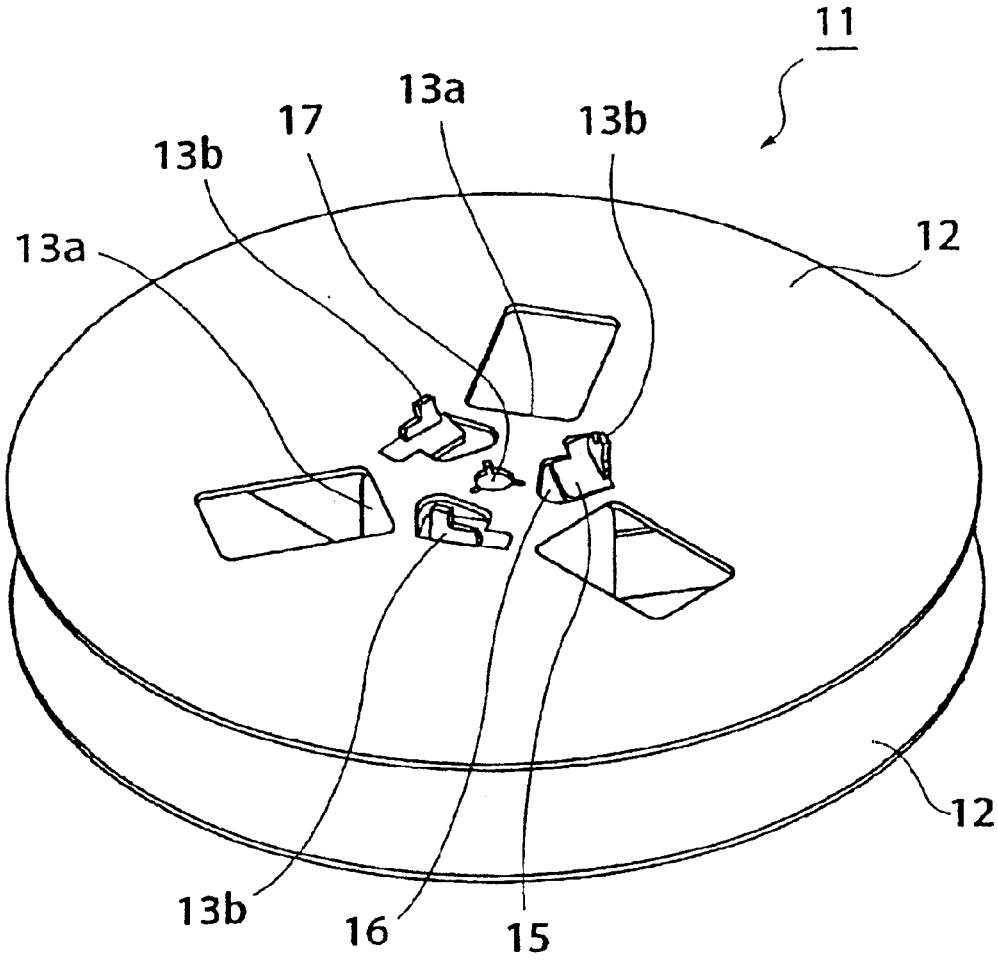
FIG. 2 is a perspective view of the same reel.
Figure 3:
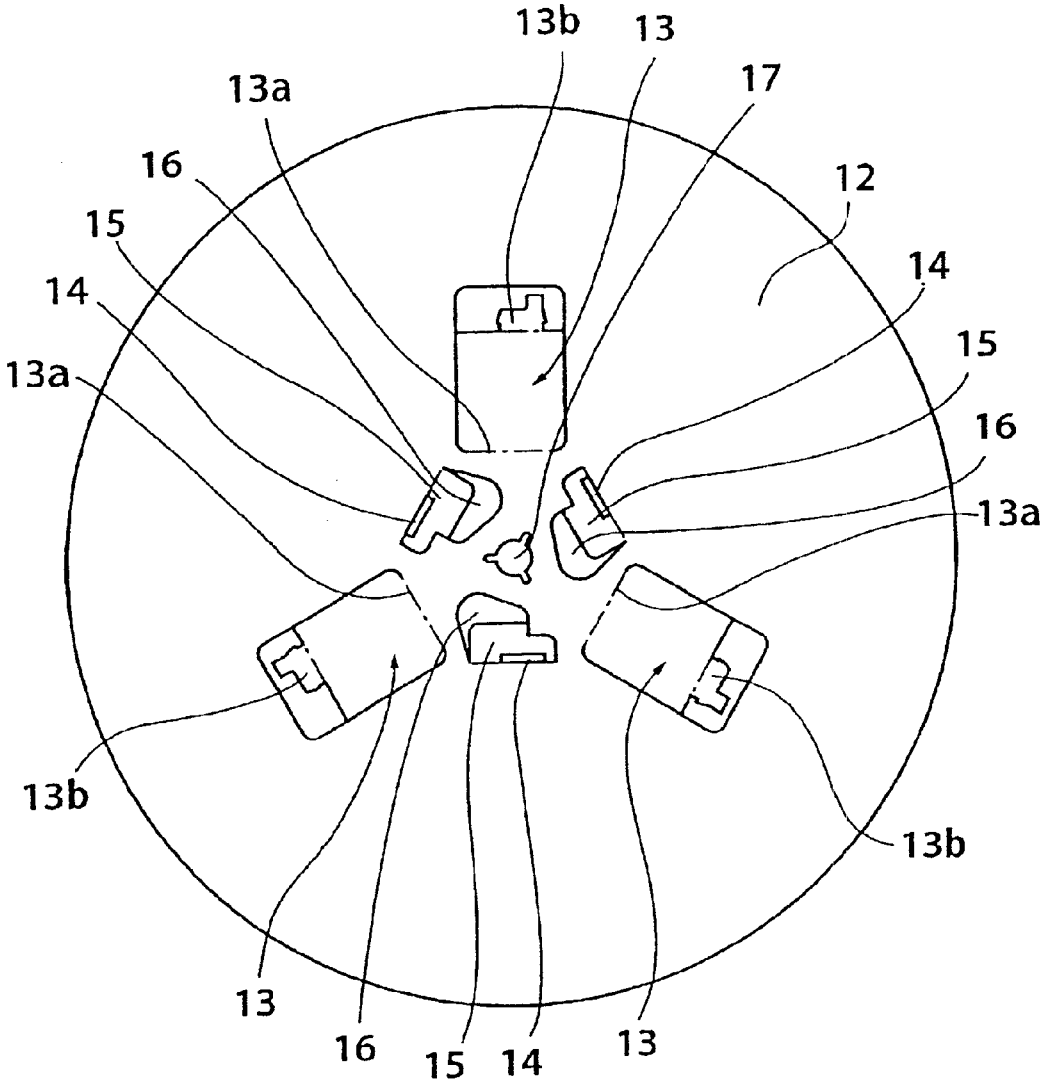
FIG. 3 is a plan view of one of the flanges of the same reel illustrating that the flaps are folded flat.
Figure 4:
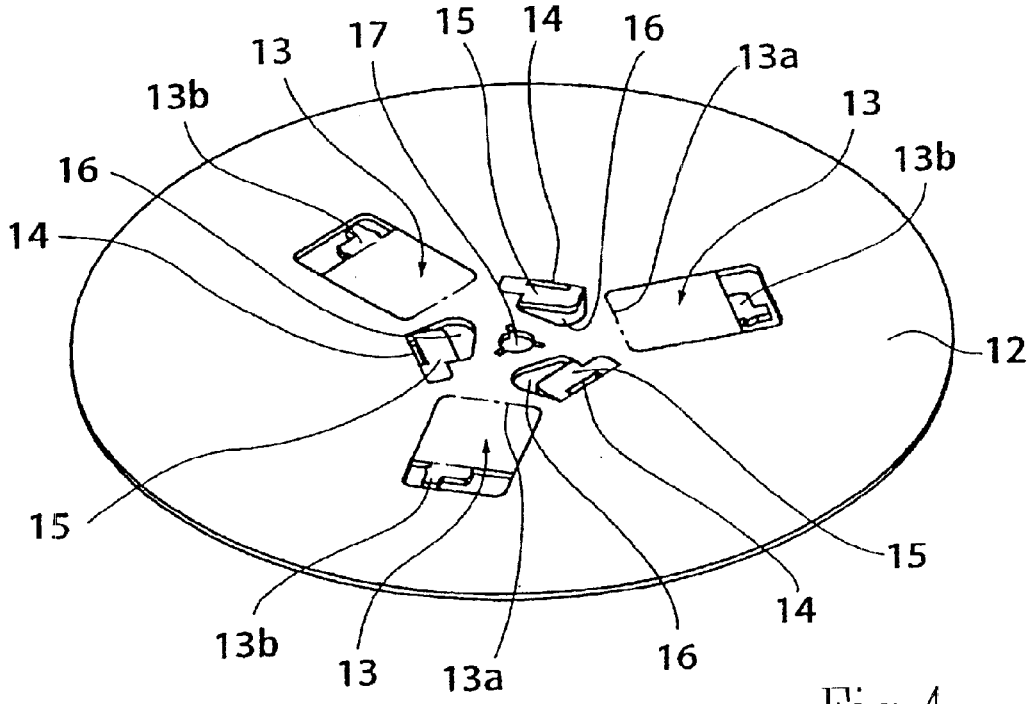
FIG. 4 is a perspective view of one of the flanges of the same reel illustrating that the flaps are folded flat.
Figure 5:
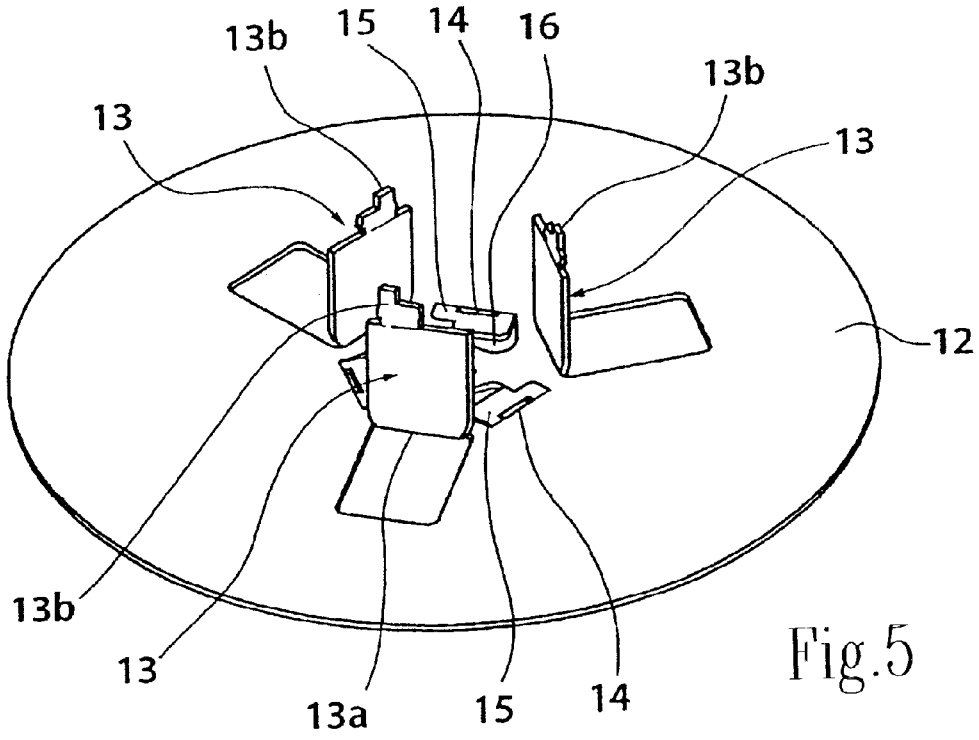
FIG. 5 is a perspective view of one of the flanges of the same reel illustrating that the flaps are raised into an upright position.

A first embodiment of the embossed carrier tape reel of the present invention is shown in FIGS. 1 through 5. FIG. 1 is an exploded perspective view of this reel, FIG. 2 is a perspective view of the same reel, FIG. 3 is a plan view of one of the flanges of the reel in which the flaps are folded flat, FIG. 4 is a perspective view of one of the flanges in which the flaps are folded flat, and FIG. 5 is a perspective view of one of the flanges in which the flaps are raised into an upright position.

Reel 11 consists of a pair of flanges 12, 12, each of which consists of a disk made of cardboard. In each flange 12, three flaps 13 are formed by stamping at equal intervals in the circumferential direction of the flange 12. The flaps extend in the radial direction of the flange 12 and have base ends 13*a* on the side of the central part of the flange 12. Furthermore, projecting parts 13*b* are formed on the tip ends of these flaps 13.

Near the central part of each flange 12, three slits 14, which extend in the circumferential direction of the flange 12, are formed at equal intervals on a circle which is concentric with the flange 12 and which includes the base ends 13*a* of the flaps 13. On the sides of the slits 14 that face the center of each flange 12, three anchoring flaps 15 are formed by stamping at equal intervals in the circumferential direction of the flange 12, so that the base ends of these flaps include the slits 14. Holes 16 for the insertion of the fingers are formed on the sides of the tip ends of these anchoring flaps 15. A through-hole 17 for a rotating shaft is formed in the center of each flange 12, so that the assembled reel 11 can be attached in a specified position in such a manner that rotation is possible.

In order to assemble the reel 11, the flaps 13 of the respective flanges 12 are first pulled into an upright position (see FIG. 5), and the two flanges 12 are positioned facing each other with the flaps 13 in between (see FIG. 1). In this embodiment, the tip ends of the flaps 13 of one flange 12 are positioned so that they face the slits 14 of the other flange 12. Then, while both flanges 12 are held with the fingers inserted into the finger insertion holes 16 of the flanges 12, the projecting parts 13*b* of the flaps 13 of one flange 12 are inserted into the slits 14 of the other flange 12, so that the flanges 12 are fastened together, thus making it possible to form a reel 11. The engaging force between the projecting parts 13*b* and the slits 14 can be increased by folding the anchoring flaps 15 in the direction in which the flaps 13 have been pulled into an upright position, after the projecting parts 13*b* of the flaps 13 have been inserted into the slits 14.

In the case of reels 11 consisting of the above-mentioned structure, if the flaps 13 are caused to lie flat (see FIGS. 3 and 4), the reels 11 can be shipped without the flanges 12 becoming excessively bulky. Furthermore, since the flaps 13 that form the shaft part are integral parts of the flanges 12, there is no need for a separate shaft part, and the number of parts required can therefore be reduced. In addition, there is no need for any separation of parts at the time that the reels are discarded. As long as the strength of the flanges 12 can be maintained, there are no restrictions on the number of flaps 13; this number may be varied as appropriate.

Figure 6:
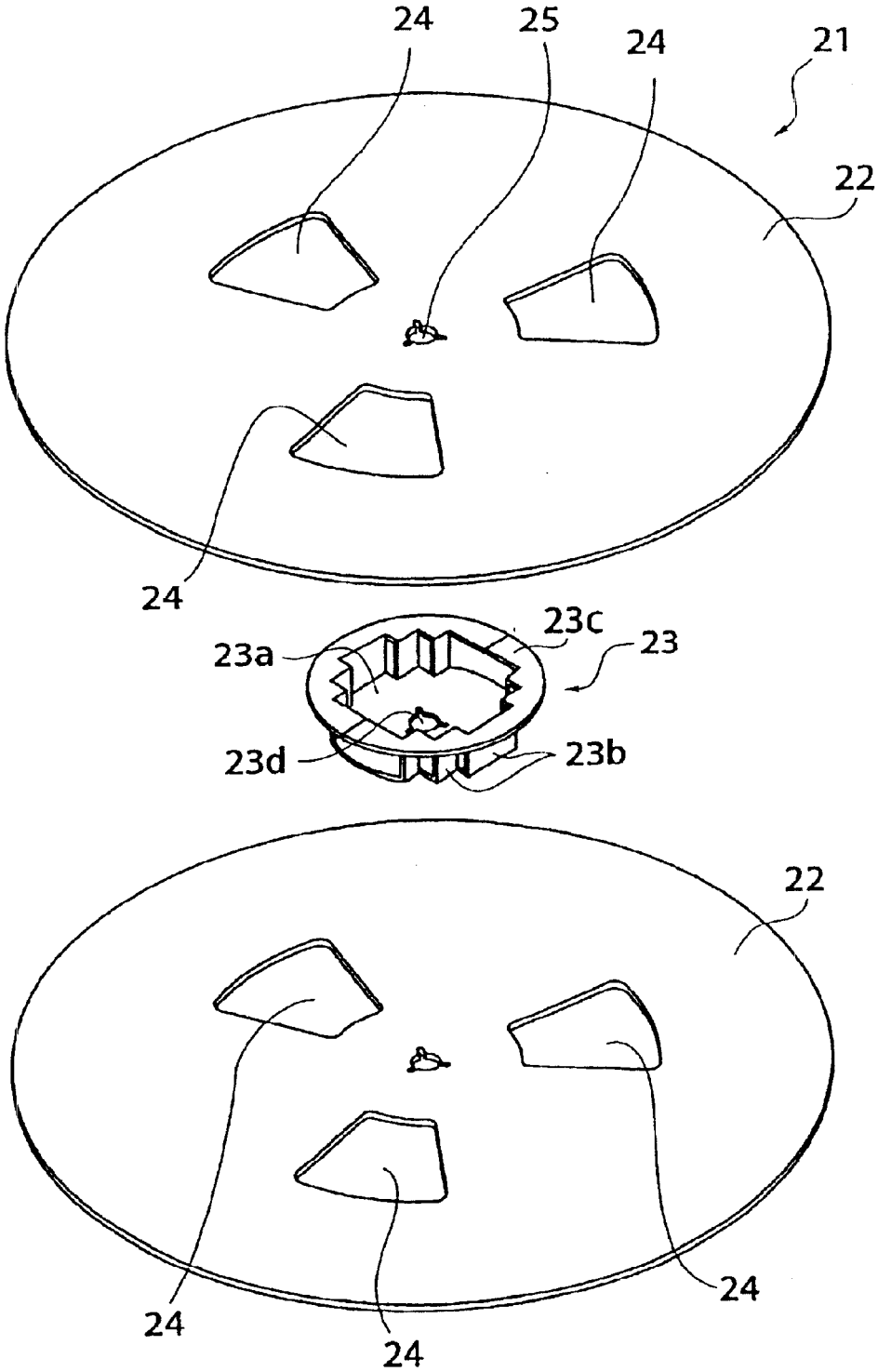
FIG. 6 is an exploded perspective view which illustrates a second working configuration of the embossed carrier tape reel of the present invention.
Figure 7:
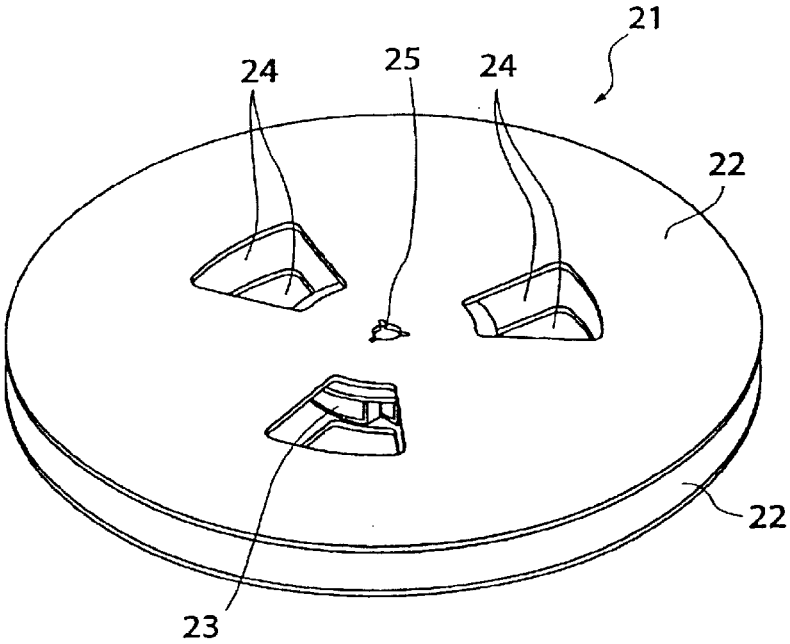
FIG. 7 is a perspective view of the reel shown in FIG. 6.
Figure 8:
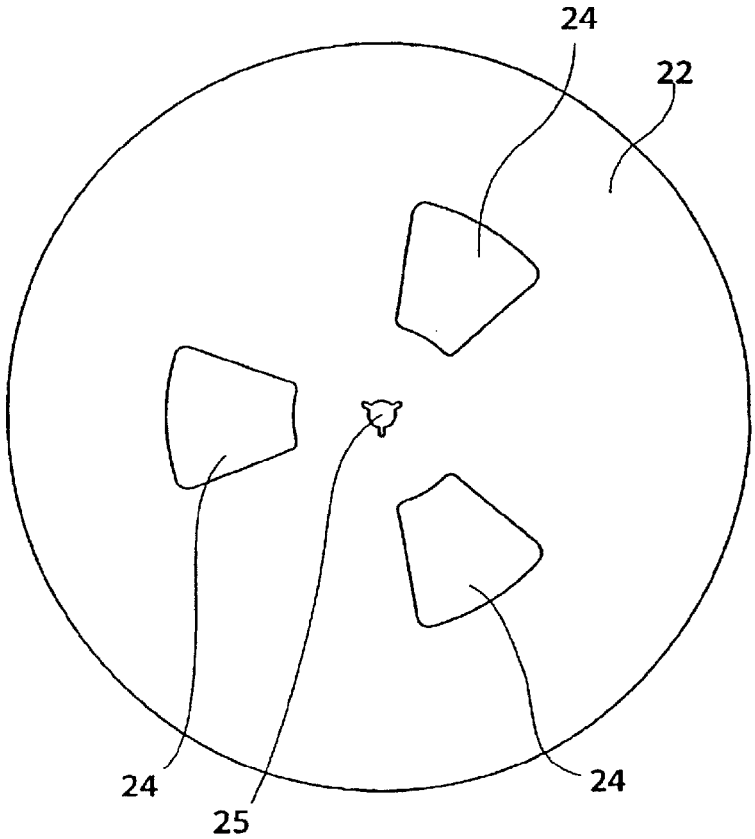
FIG. 8 is a plan view of one of the flanges of the reel shown in FIG. 6.
Figure 9:
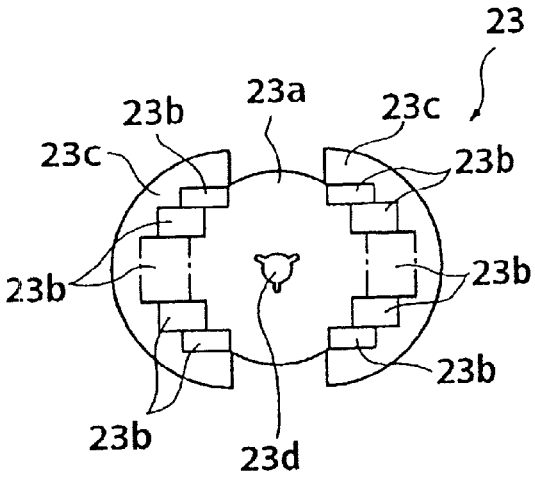
FIG. 9 is a plan view of the reel shown in FIG. 6 illustrating the shaft part in a folded flat configuration.
Figure 10A:
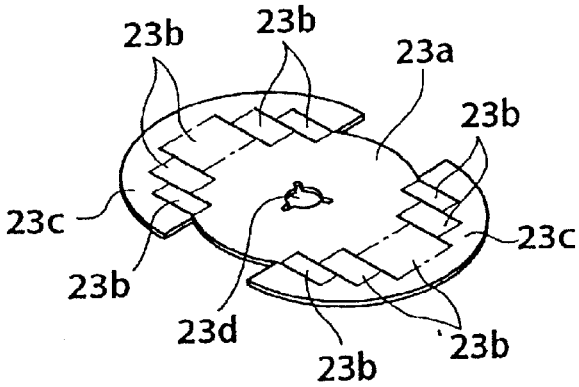
FIG. 10 is an operating diagram of the shaft part in the reel of FIG. 6.
Figure 10B:
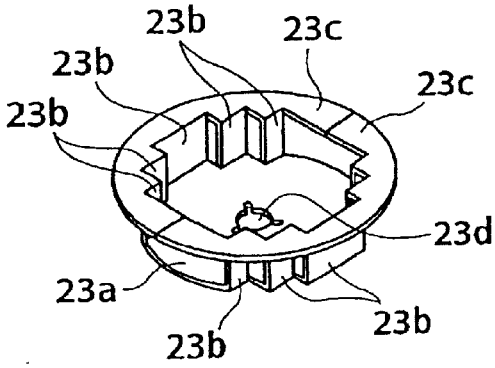
Figure 11:
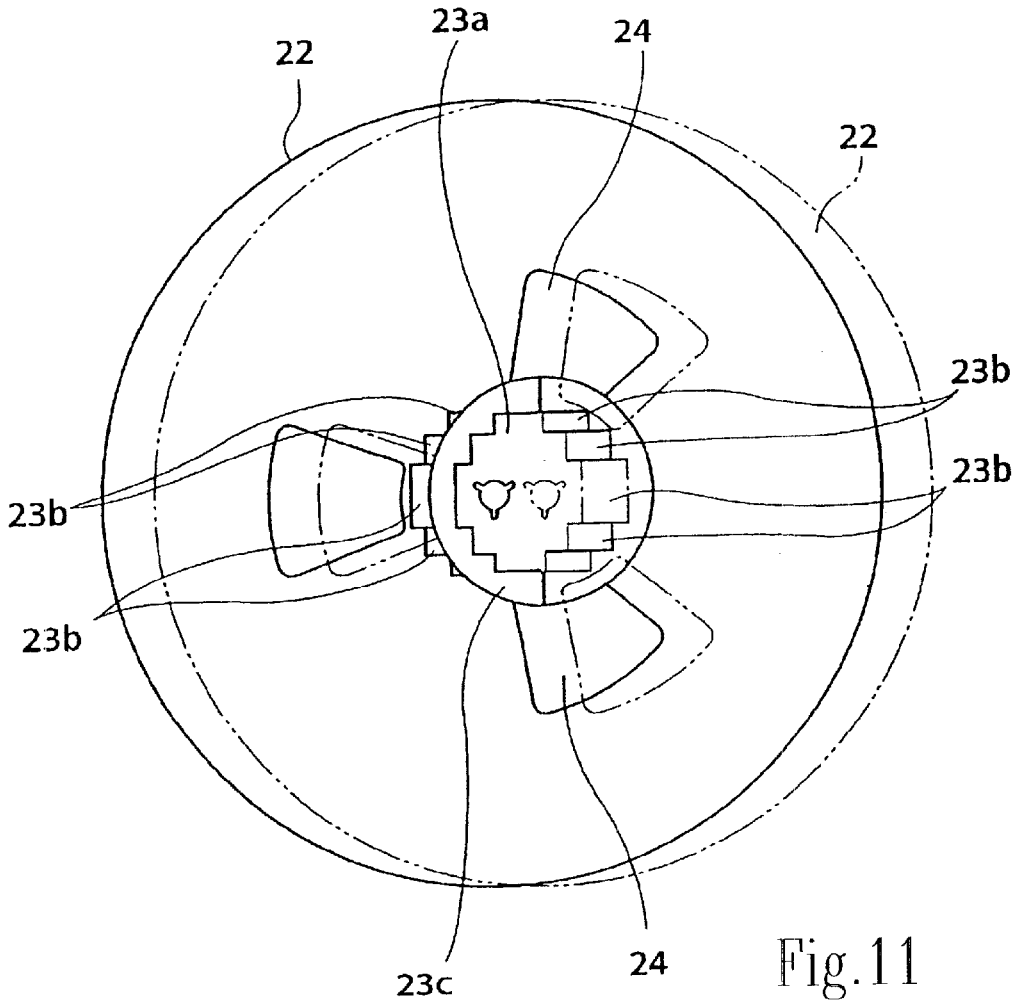
FIG. 11 is a plan view showing the shaft part fastened to the flanges.

A second embodiment of the embossed carrier tape reel of the present invention is shown in FIGS. 6 through 10. FIG. 6 is an exploded perspective view of this reel, FIG. 7 is a perspective view of the same reel, FIG. 8 is a plan view of one of the flanges of this reel, FIG. 9 is a plan view of this reel which the shaft part is folded flat, FIG. 10 is a operating diagram of the shaft part, and FIG. 11 is a plan view showing the shaft part fastened to the flanges is folded flat.

Reel 21 consists of a pair of flanges 22, 22 that have a disk shape, and a shaft part 23. All of these parts are made of cardboard. In each flange 22, holes 24 for the insertion of the fingers are formed at equal intervals in the circumferential direction of the flange 22. A through-hole 25 for a rotating shaft is formed in the center of each flange 22, so that the assembled reel 21 can be attached in a specified position in such a manner that rotation is possible.

As is shown in FIG. 9, the shaft part 23 has a first joining part 23*a* which has the form of a disk. A plurality of plate-form members 23*b* extend parallel to each other from opposite side parts of the joining part 23*a*. The other ends of these plate-form members 23*b* are connected to the inside circumferences of second joining parts 23*c* which are formed by splitting a disk into parts that have a circular arc shape. A through-hole 23*d* which corresponds to the through-holes 25 in the flanges 22 is formed in the center of the first joining part 23*a*.

In order to assemble a reel 21, the second joining parts 23*c* are first arranged in an annular configuration and placed in a three-dimensional state (see FIG. 10(*b*)). Then, the reel 21 can be formed by fastening the first joining part 23*a* and second joining parts 23*c* to the respective centers of the pair of flanges 22.

In the case of reels 21 consisting of the above-mentioned structure, the shaft parts 23 and flanges 22 can be stacked and shipped without excessive bulkiness by folding the plate-form members 23*b* of the shaft parts 23 flat as shown in FIG. 11. Furthermore, at the time of use, the reels 21 can be assembled in a one-touch operation merely by raising the plate-form members 23*b* of the shaft parts 23 into an upright state; accordingly, the working characteristics are good. Moreover, since the flanges 22 and shaft parts 23 are both made of cardboard, there is no need for the separation of parts when the reels are discarded. In addition, there is little danger of the shaft parts 23 being lost during shipping.

Figure 12:
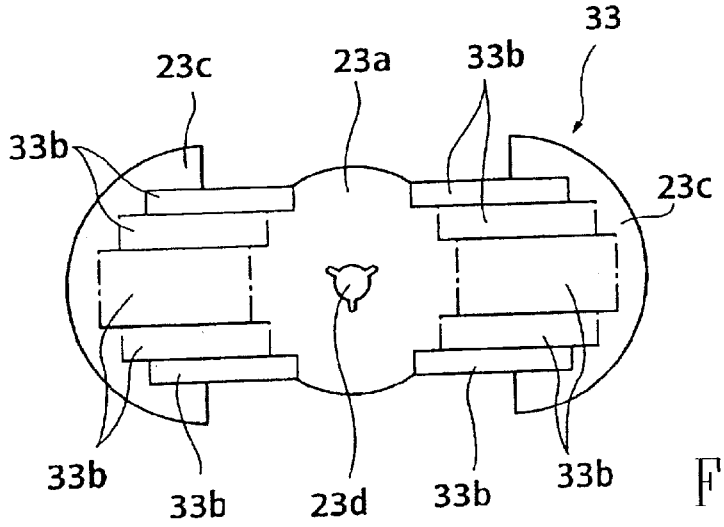
FIG. 12 is a plan view showing a modified shaft part in a folded flat configuration.
Figure 13A:
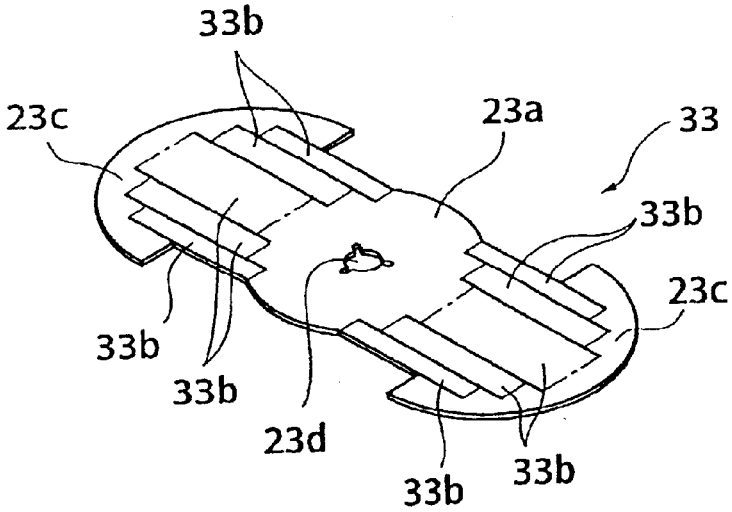
FIG. 13 is an operating diagram of the shaft part shown in FIG. 12.
Figure 13B:
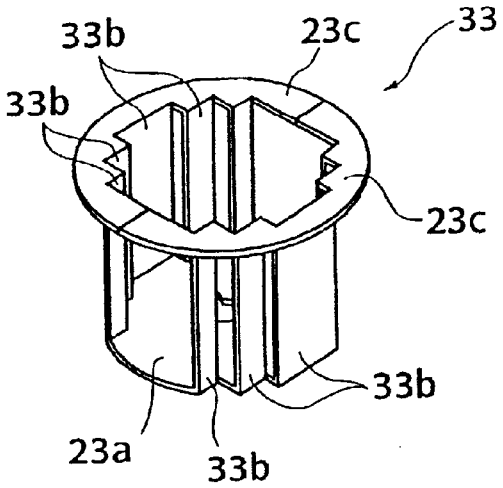

Another embodiment of the shaft part shown in FIGS. 6–10 is shown in FIGS. 12 and 13. FIG. 12 is a plan view of the reel with the shaft part of the reel folded flat, and FIG. 13 is an operating diagram of the shaft part. Parts which are substantially the same as parts shown in FIGS. 6–10 are labeled with the same symbols, and a description of these parts is omitted.

In this shaft part 33, the plate-form members 23*b* of the shaft part 23 in the reel 21 are changed to plate-form members 33*b* that have a different length. By using the shaft part 33 instead of the above-mentioned shaft part 23, it is possible to form a reel 21 in which the spacing of the flanges 22 is different.

Figure 14:
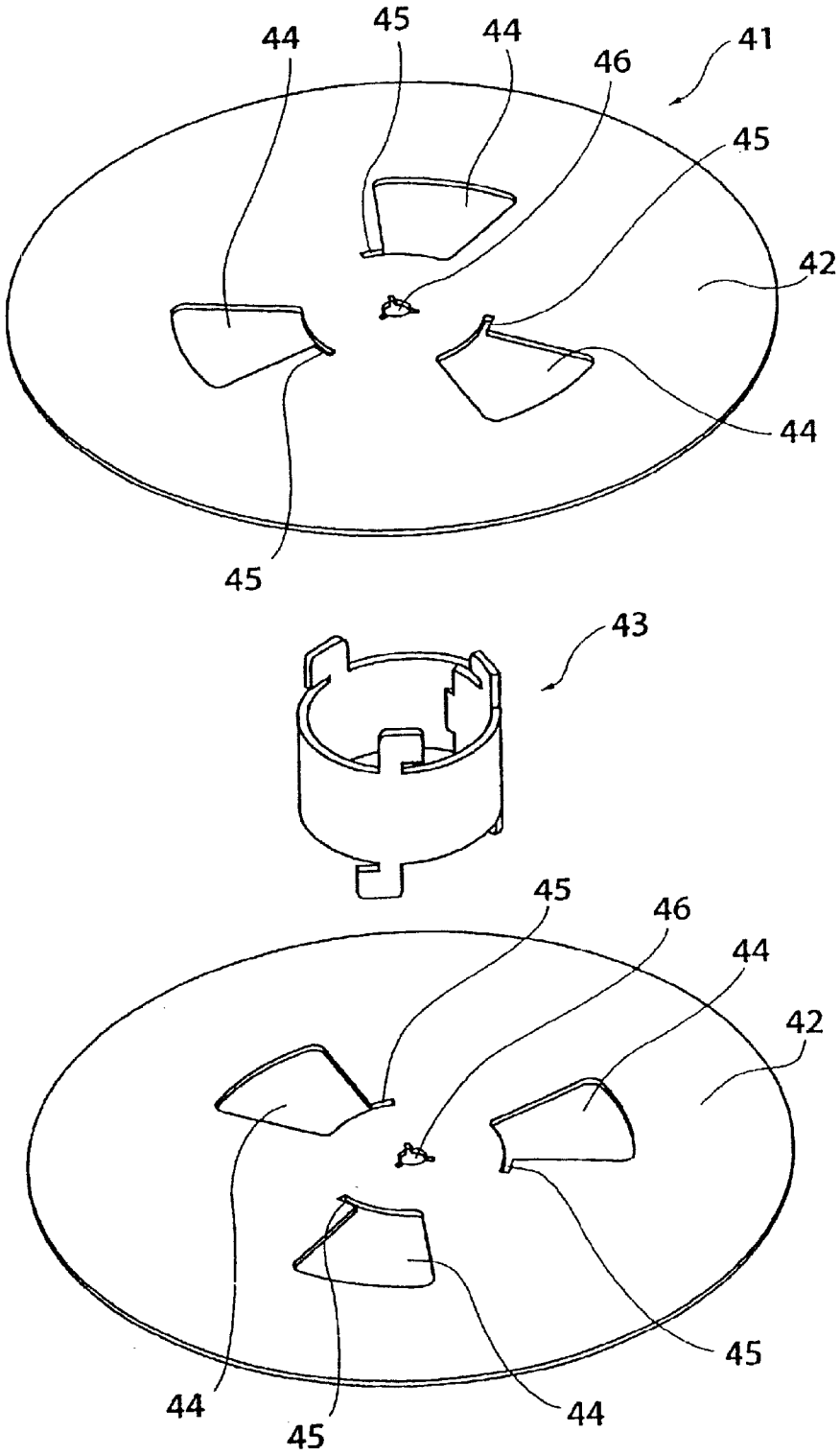
FIG. 14 is an exploded perspective view which illustrates a third embodiment of the embossed carrier tape reel of the present invention.
Figure 15:
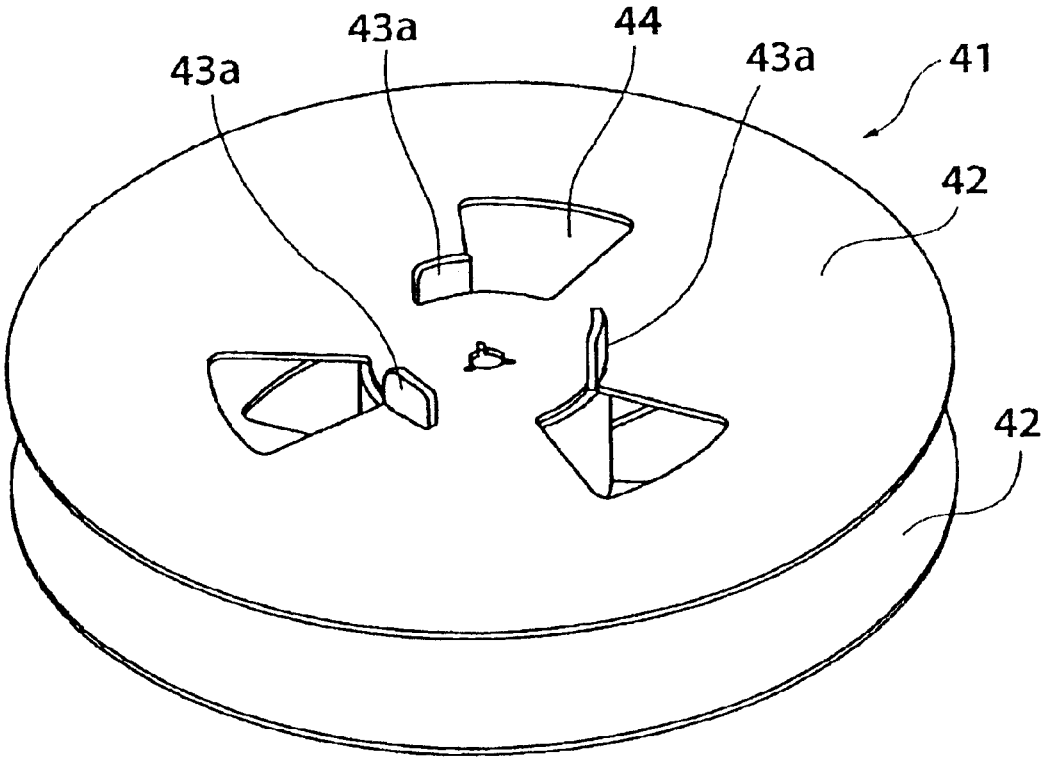
FIG. 15 is a perspective view of the reel shown in FIG. 14.
Figure 16:
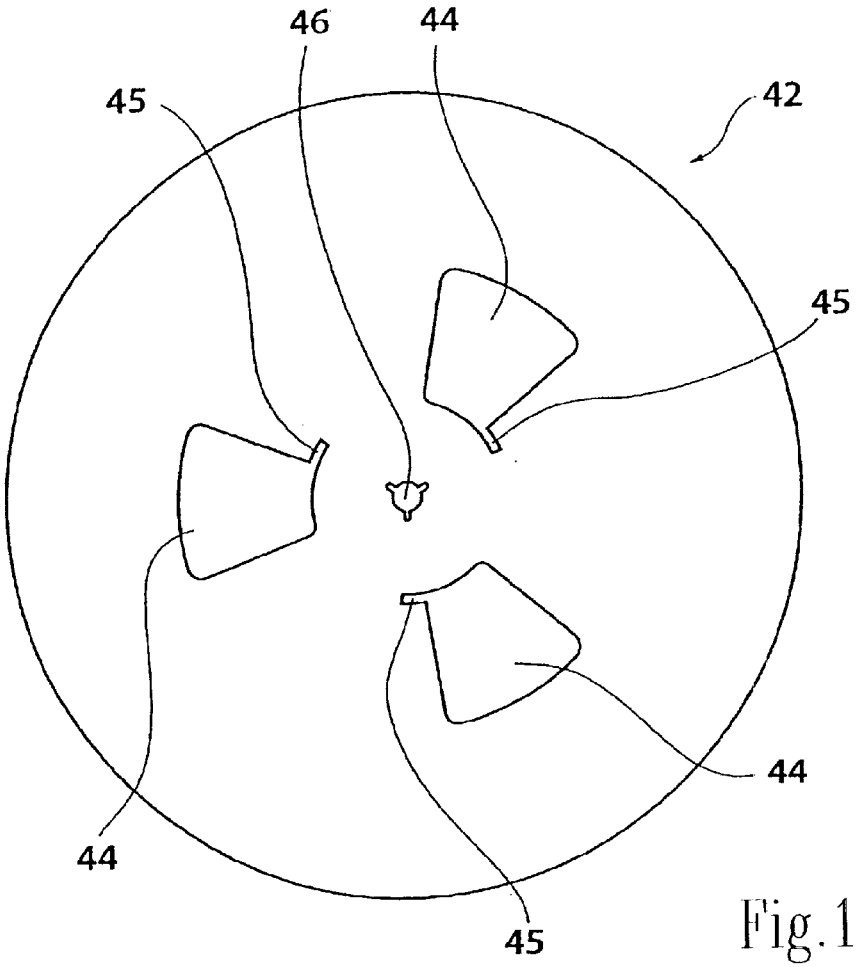
FIG. 16 is a plan view of one of the flanges of the reel shown in FIG. 14.
Figure 17:
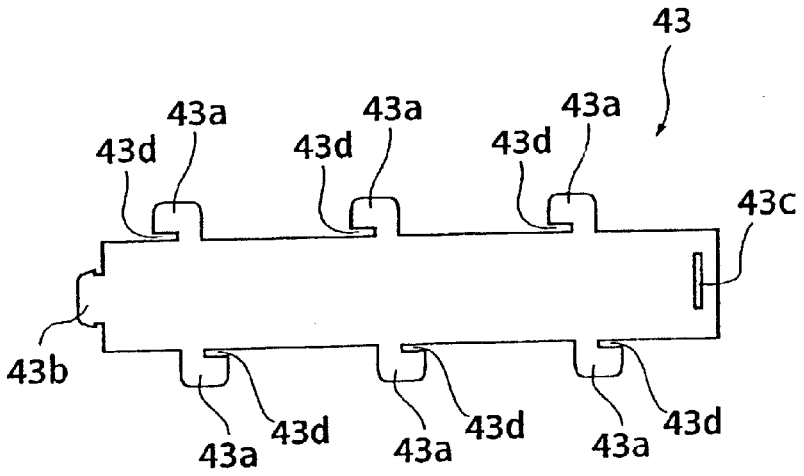
FIG. 17 is a plan view of the reel of FIG. 14 in which the shaft part of the reel is in a planar state.
Figure 18:
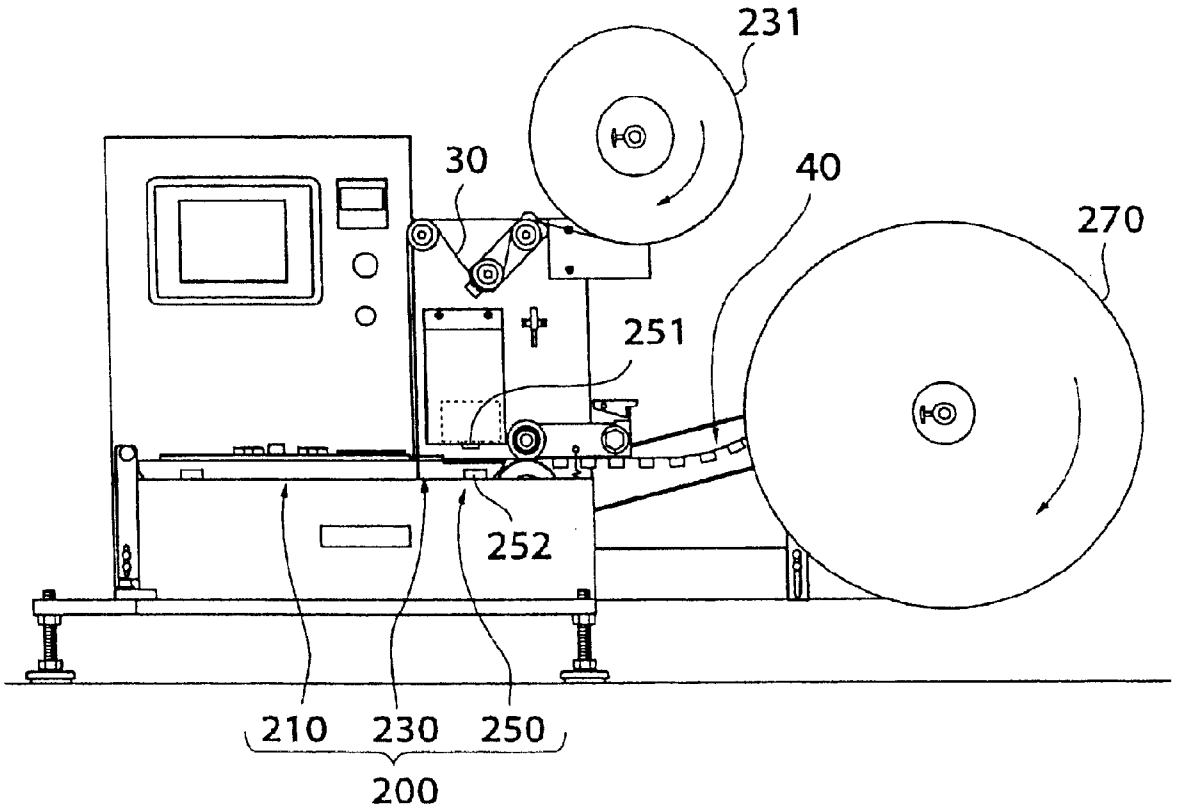
Fig.18 PRIOR ART
FIG. 18 is a front view which shows an embossed carrier tape reel installed as the after-stage of a sealing apparatus.
Figure 19:
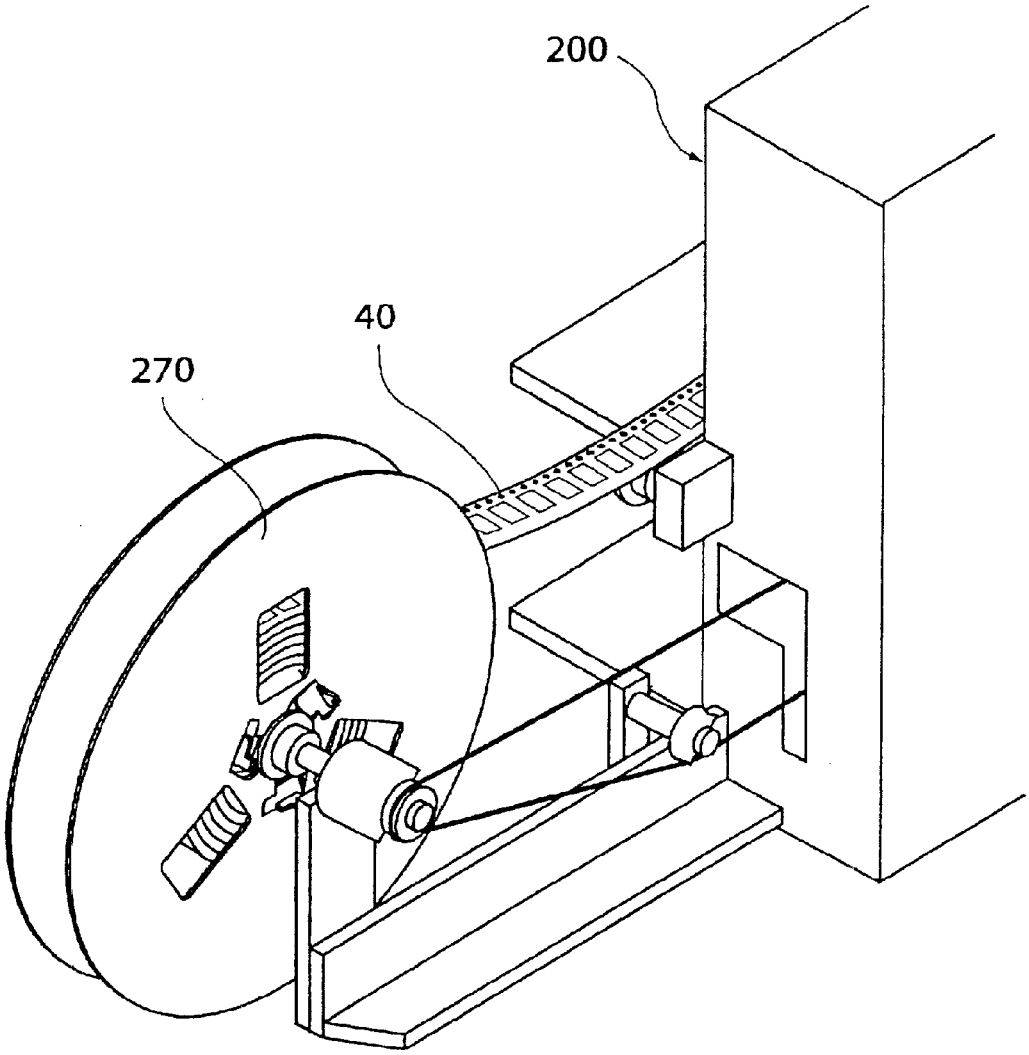
Fig.19 PRIOR ART
FIG. 19 is a perspective view which shows an embossed carrier tape reel installed as the after-stage of a sealing apparatus.
Figure 20:
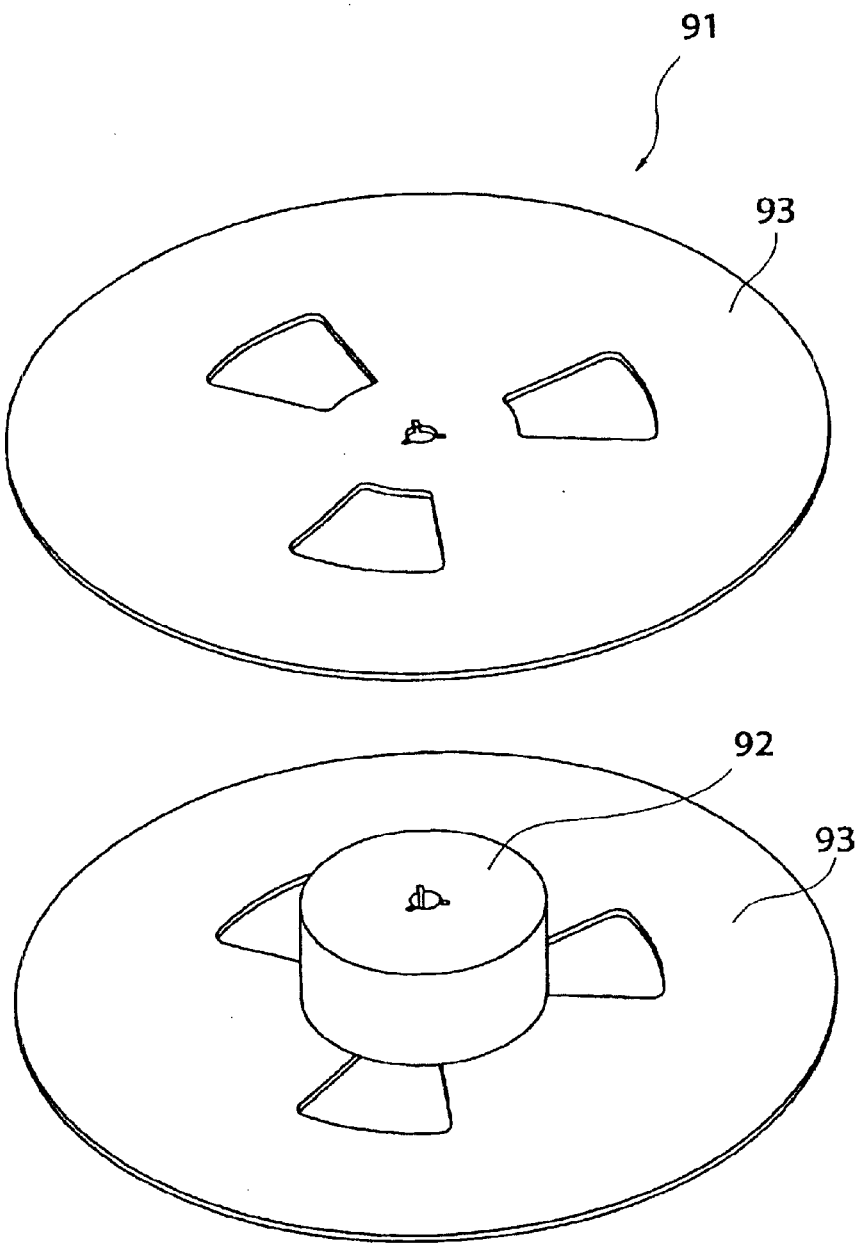
Fig.20 PRIOR ART
FIG. 20 is an exploded perspective view which illustrates a conventional embossed carrier tape reel known in the prior art.

A third embodiment of the embossed carrier tape reel of the present invention is shown in FIGS. 14 through 17. FIG. 14 is an exploded perspective view of this reel, FIG. 15 is a perspective view of the same reel, FIG. 16 is a plan view of one of the flanges of this reel, and FIG. 17 is a plan view of this reel in which the shaft part of the reel is in a planar state.

Reel 41 consists of a pair of flanges 42, 42 that have a disk-form shape, and a shaft part 43 that has a tubular shape. All of these parts consist of cardboard. In each flange 42, holes 44 for insertion of the fingers are formed at equal intervals in the circumferential direction of the flange 42. A slit 45 which extends in the circumferential direction of the flange 42 is formed at one end of the inner circumference of each finger insertion hole 44. Furthermore, a through-hole 46 for a rotating shaft is formed in the center of each flange 42, so that the assembled reel 41 can be attached in a specified position in such a manner that rotation is possible.

As is shown in FIG. 17, the shaft part 43 has a band-form shape when this shaft part 43 is in a planar state. Projecting parts 43*a* that protrude in the direction of width are formed at equal intervals along the direction of length on the opposite end parts in the direction of width. An engaging projecting part 43*b*, which protrudes in the direction of length, is formed on one of the opposite end parts in the direction of length. An engaging slit 43*c*, in which the engaging projecting part 43*b* is inserted, is formed in the other end part. Engaging slits 43*d* which engage with the slits 45 formed in the flanges 42 are formed in one side of the base part of each of the above-mentioned projecting parts 43*a*.

In order to assemble the reel 41, the engaging projecting part 43*b* of the band-form shaft part 43 is first inserted into the engaging slit 43*c*, so that the shaft part 43 is formed into a tubular shape. A reel 41 can then be formed by engaging the engaging slits 43*d* of the projecting parts 43*a* with the slits 45 of the flanges 42.

In the case of reels 41 consisting of the above-mentioned structure, the reels 41 can be shipped without excessive bulkiness in a state in which the band-form shaft parts 43 and flanges 42 are respectively stacked in sheet form. Since the flanges 42 and shaft parts 43 are both made of cardboard, there is no need for any separation of parts when the reels are discarded. Furthermore, even if no bonding agent, etc., is used, the flanges 42 and shaft parts 43 can be fastened together merely by engaging the engaging slits 43*d* of the projecting parts 43*a* with the slits 45 formed in the flanges 42.

In all of the embodiments, the shaft part that connects the central parts of a pair of flanges at a specified spacing is formed with a foldable structure, such that the reel of the present invention can be stacked and shipped in large quantities by folding the shaft part so that the space formed between the flanges is eliminated. Accordingly, shipping costs can be reduced. Furthermore, since the shaft part and flanges are both made of cardboard, there is no need for any separation of parts when the reel is discarded.

We claim:

1. A reel for an embossed earner tape, comprising;

a pair of flanges that have through-holes for receiving a rotating shaft;

a shaft part that connects central portions of the flanges at a specified spacing;

the shaft part has a foldable structure including a plurality of flaps having tip end portions which are formed in at least one of the pair of flanges, the flaps are pulled into an upright position, and the tip end portions of the flaps are inserted into slits formed in an opposing flange of the pair of flanges; and the flanges and the shaft part are made of cardboard.

2. The reel of claim 1, wherein the flaps extend in a radial direction of the flange and have base ends proximate the central portion of the flange.

3. The reel of claim 1, wherein the tip end portions have projecting parts that are received in the slits.

4. The reel of claim 1, further comprising anchoring flaps proximate the slits that fix the end portions in position.

5. The reel of claim 1, wherein the flanges have finger insertion holes.

6. A reel for an embossed carrier tape, comprising;

a pair of flanges that have through-holes for receiving a rotating shaft;

a shaft part that connects central portions of the flanges at a specified spacing;

the shaft part has a single piece foldable structure including joining parts that are bonded to the central portions of the pair of flanges, and a plurality of plate-form members that connect the joining parts to each other, the plate-form members are formed parallel to each other and are pulled into an upright position with respect to the joining parts; and the flanges and the shaft part are made of cardboard.

7. The reel of claim 6, wherein the joining parts form a disk shape.

8. The reel of claim 7, wherein the disk shape has a through-hole corresponding to the through-holes in the pair of flanges.

9. The reel of claim 6, wherein the flanges have finger insertion holes.

10. A reel for an embossed carrier tape, comprising;

a pair of flanges that have through-holes for receiving a rotating shaft;

a shaft part that connects central portions of the flanges at a specified spacing;

the shaft part is a foldable structure including a band-form member that is connected into a tubular shape, the band-form member having a plurality of projecting parts which are inserted into slits formed in finger insertion holes on the pair of flanges, the projecting parts are disposed on a first side and a second side of the band-form member with respect to the direction of width of the band-form member; and the flanges and the shaft art are made of cardboard.

11. The reel of claim 10, further comprising first engaging parts extending from the projecting parts on the first side and second engaging parts extending from the projecting parts on the second side, the first engaging parts extending in a direction opposite from the second engaging parts to fix the band-form member to the flanges.

12. The reel of claim 11, wherein the first and second engaging parts are formed essentially perpendicular to the projecting parts and are positioned adjacent to an outer surface of the flange.

13. The reel of claim 10, wherein the slits are formed in a circumferential direction of the flange.

* * * * *